US007478648B2

(12) United States Patent
Lundgren

(10) Patent No.: US 7,478,648 B2
(45) Date of Patent: Jan. 20, 2009

(54) HYDRAULIC PRESSURE ACCUMULATOR

(75) Inventor: Anders Wilhelm Lundgren, Degerhamn (SE)

(73) Assignee: Atlas Copco Construction Tools AB, Nacka (SE)

( * ) Notice: Subject to any disclaimer, the term of this patent is extended or adjusted under 35 U.S.C. 154(b) by 0 days.

(21) Appl. No.: 10/592,602

(22) PCT Filed: Mar. 7, 2005

(86) PCT No.: PCT/SE2005/000326

§ 371 (c)(1),
(2), (4) Date: Nov. 21, 2006

(87) PCT Pub. No.: WO2005/087444

PCT Pub. Date: Sep. 22, 2005

(65) Prior Publication Data

US 2007/0199724 A1 Aug. 30, 2007

(30) Foreign Application Priority Data

Mar. 12, 2004 (SE) ..... 0400611

(51) Int. Cl.
*F16L 55/04* (2006.01)

(52) U.S. Cl. ..... 138/31; 138/30; 173/200; 175/417

(58) Field of Classification Search ..... 138/30, 138/31; 173/114, 200, 128, 204; 175/417, 175/296

See application file for complete search history.

(56) References Cited

U.S. PATENT DOCUMENTS 2,878,834 A * 3/1959 Mercier ..... 138/30
2,931,392 A * 4/1960 Mercier ..... 138/30
3,088,492 A * 5/1963 Mercier ..... 138/30
3,380,470 A * 4/1968 Culpepper, Jr. et al. ..... 137/269
3,428,091 A * 2/1969 Nobuyuki et al. ..... 138/30

(Continued)

FOREIGN PATENT DOCUMENTS

GB 2094888 A 9/1982

*Primary Examiner*—James F Hook
(74) *Attorney, Agent, or Firm*—Frishauf, Holtz, Goodman & Chick, P.C.

(57) ABSTRACT

A hydraulic breaker hammer comprises a housing (10) with a longitudinal bore (12), a cylinder sleeve (14), and a cylinder sleeve (14) engaging rear end cover (16), a hammer piston (15) reciprocally powered in the cylinder sleeve (14) for delivering blows to a working implement inserted in a guide sleeve (20) at the front end of the bore (12), wherein the guide sleeve (20) is provided with radial openings (22*a,b*) for communication of lubricant from a lubricant supply passage (21) in the housing (10) to the inside of the guide sleeve (20), and the guide sleeve (20) is provided with external seal rings (23 *a-d*) forming annular compartments located between the lubricant supply passage (21) and the radial openings (22 *a,b*) for spreading lubricant on the outside surface of the guide sleeve (20), a distribution valve (31) communicating with the pressure fluid source and the cylinder sleeve (14) and comprising both a clearance seal means (44) and a seat seal (45,46) for improved tightness, and a pressure accumulator (50) with an expansion chamber (52) divided by a flexible membrane (53), wherein a movable membrane support member (59) is limited in its outward displacement by a bulge shaped projection (66) formed integrally with one of the expansion chamber walls (58).

16 Claims, 1 Drawing Sheet

U.S. PATENT DOCUMENTS 3,566,647 A * 3/1971 Inoue ..... 72/56
3,625,256 A * 12/1971 Smith ..... 138/30
3,903,972 A 9/1975 Bouyoucos et al.
3,911,789 A 10/1975 Bouyoucos
4,022,108 A * 5/1977 Juvonen ..... 91/276
4,206,902 A * 6/1980 Barthel et al. ..... 251/57
4,552,227 A * 11/1985 Wohlwend ..... 173/15
4,628,964 A * 12/1986 Sugimura et al. ..... 138/30
4,638,838 A * 1/1987 Richard et al. ..... 138/30
4,676,323 A * 6/1987 Henriksson ..... 173/200
5,445,232 A * 8/1995 Brannstrom et al. ..... 175/417
5,893,419 A * 4/1999 Hodges ..... 173/13
7,328,753 B2 * 2/2008 Henriksson et al. ..... 173/9
2007/0068707 A1 * 3/2007 Henriksson et al. ..... 175/417
2007/0175670 A1 * 8/2007 Henriksson ..... 175/417
2008/0135270 A1 * 6/2008 Henriksson ..... 173/207

* cited by examiner

HYDRAULIC PRESSURE ACCUMULATOR

This application is a U.S. National Phase Application under 35 USC 371 of International Application PCT/SE2005/000326 filed Mar. 7, 2005.

The invention relates to a hydraulic pressure accumulator including an expansion chamber with a flexible membrane separating a pressure fluid compartment from a gas cushion compartment, and a movable membrane support member having a membrane engaging head inside the pressure fluid compartment.

In previous hydraulic accumulators, illustrated in for instance in U.S. Pat. No. 4,676,323 and GB 2 094 888, there is well known to have a membrane support in the form of a mushroom-like support member comprising a stem portion guided in a bore in a housing and a membrane engaging head which covers one or more pressure fluid communication passages at low pressure levels. In order to keep down the dimensions of the accumulator the support member stem should be as short as possible. This has been solved either by providing the support member stem with a outer end piece, as illustrated in U.S. Pat. No. 4,676,323, or providing a stop means in the gas cushion compartment of the expansion chamber for limiting the penetration depth, which made the support member.

The main object of the invention is to create a hydraulic pressure accumulator suitable for a hydraulic breaker hammer and providing a combined reliable function and simple design of a movable membrane support.

Further objects and advantages of the invention will appear from the following specification and claims.

A preferred embodiment of the invention is below described in detail with reference to the accompanying drawing.

In the drawing

Figure 1:
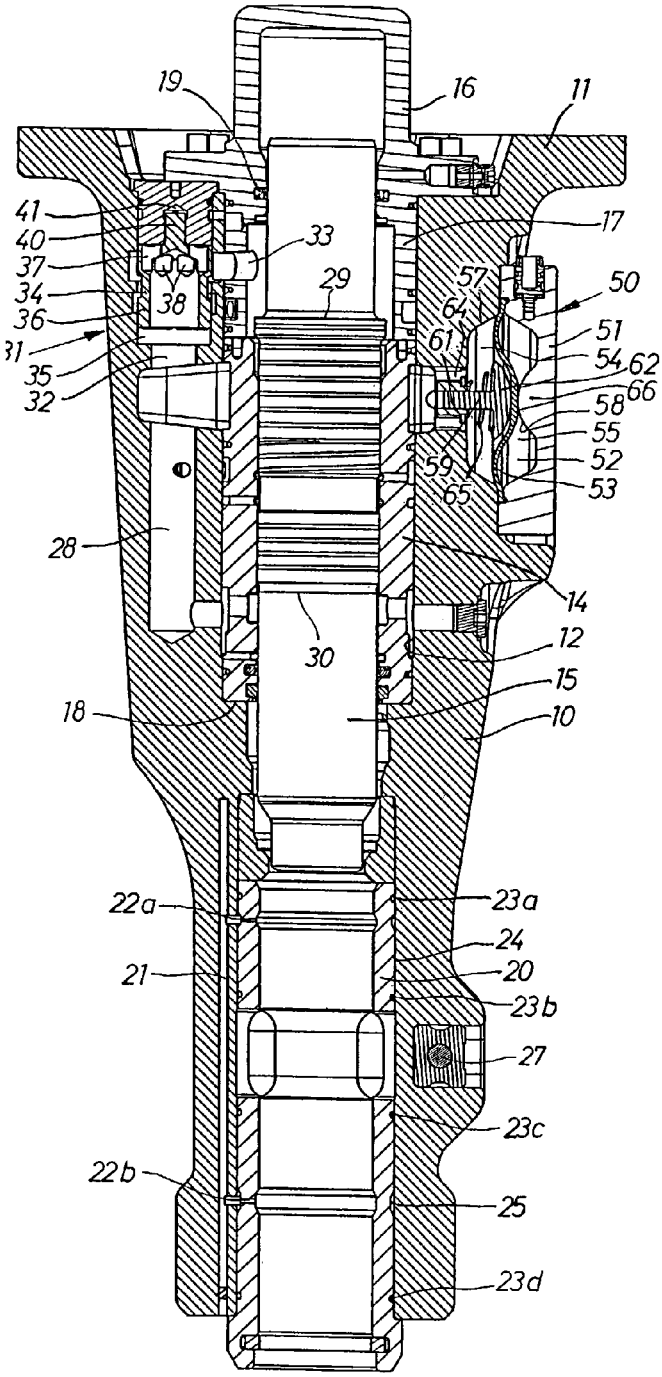
FIG. 1 shows a longitudinal section through a breaking hammer according to the invention.
Figure 2:
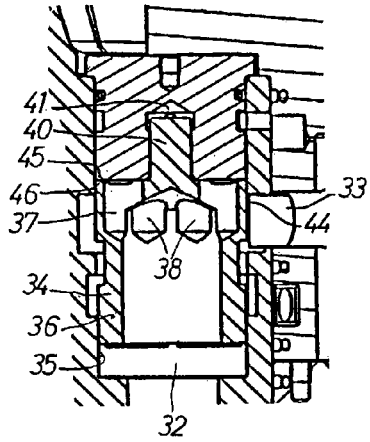
FIG. 2 shows on a larger scale a section through the distribution valve of the breaking hammer in FIG. 1.

The hydraulic breaking hammer illustrated in the drawing figures comprises a housing 10 formed with a rear mounting shoulder 11 for attachment to a mechanical carrier like an excavator arm. The housing 10 is provided with a longitudinal through bore 12 which in its rear part supports a cylinder sleeve 14 for sealingly guide a hammer piston 15. At the rear end of the housing 10 there is bolted on an end cover 16 which forms an end closure for the bore 12. This end cover 16 is formed as a one piece member with a tube shaped neck portion 17 which extends into the bore 12 and contacts the rear end of the cylinder sleeve 14. The latter is clamped in its proper position in the bore 12 between the end cover neck portion 17 and a shoulder 18 in the bore 12. The neck portion 17 also forms a guide means for the hammer piston 15 and carries a seal ring 19 for co-operation with the rear end of the hammer piston 15.

In its front part the bore 12 carries a working implement guide sleeve 20 which is intended to receive the rear end of a working implement (not shown). For lubricating the sleeve 20 on its inside there is provided a lubricant supply passage 21 in the housing 10 which via radial openings 22 *a,b* in the guide sleeve 20 communicates with the inside of the guide sleeve

Figure 3:
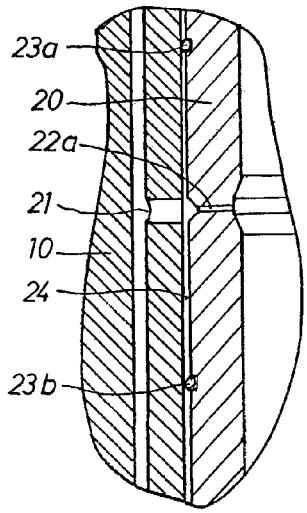
FIG. 3 shows on a larger scale a fractional section through the implement sleeve arrangement of the breaking hammer in FIG. 1.

20. Moreover, the guide sleeve 20 is provided with four O-rings 23 *a-d* on its outside the purposes of which are two, namely via frictional engagement with the bore 12 retain the sleeve 20 in the bore 12, and to seal off between them two annular compartments 24,25. The radial openings 22 *a,b* in the guide sleeve 20 are located between the O-rings 23 *a,b* and 23 *c,d*, respectively, such that lubricant has to pass through the compartments 24,25 to reach the radial openings 22 *a,b* and the guide sleeve 20 inside. See FIG. 3. Accordingly, the compartments 24,25 are filled with lubricant (grease), and due to the relative axial extension of the compartments 24,25 lubricant is spread over a substantial part of the outside surface of the guide sleeve 20, thereby, preventing seizure of the guide sleeve 20 relative to the bore 12.

The housing 10 has a pressure fluid inlet passage 28 for supplying motive pressure fluid to the cylinder sleeve 14 so as to drive the hammer piston 15 in its reciprocating movement for delivering blows to a working implement inserted in the guide sleeve 20. The piston 15 has two oppositely facing drive surfaces 29,30, whereof the lower surface 30 is continuously connected to the pressure fluid source, whereas the upper surface 29 is intermittently pressurised via a pressure fluid distribution valve 31. The distribution valve 31 has a fluid inlet 32 communicating with the pressure fluid inlet passage 28, and a fluid outlet 33 communicating with the upper drive surface 29 of the hammer piston 15. Moreover, the distribution valve 31 comprises a valve bore 35 and a valve element 34 sealingly guided in the bore 35. The valve element 34 consists of a tubular guide portion 36 guided in the bore 35, and an end wall 37. In the end wall 37 there are through openings 38 for connecting the inside of the guide portion 36 and the fluid inlet 32 with the outer surface of the end wall 37. The end wall 37 is provided with a reduced diameter activation portion 40 which extends co-axially in a direction opposite the guide portion 36 and is received in an intermittently pressurised activation bore 41.

The end wall 37 has a slightly larger cross section than the guide portion 36, and since the valve element 34 is open ended the fluid pressure will act constantly both on the surface area formed by the guide portion 36 and via the openings 38 on the outer surface of the end wall 37. In the position where the activation bore 41 is connected to tank, i.e. no pressure acting on the activation portion 40, the remaining part of the end wall 37 is smaller than the guide portion area resulting in a closing force on the valve element 34. When instead the activation bore 41 is pressurised the total area of the end wall plus activation portion 40 will generate a force that will dominate over the force generated by the pressure acting on the guide portion area. This means that the valve element 34 is shifted to its open position. (Not shown).

The valve element 34 is provided to control the communication between the inlet 32 and the outlet 33, and for that purpose the valve element 34 is formed with a double seal function, namely both a clearance seal and a seat seal. The clearance seal function is obtained by a circumferential surface 44 of the end wall 37 co-operates with the valve bore 35 as illustrated in the closed position of the valve shown in FIG. 1. The seat seal is accomplished by an annular seat 45 at the end of the bore 35 in co-operation with an annular contact surface 46 on the end wall 37. By a combined clearance seal and seat seal as described above there is obtained a high degree of valve tightness and, hence, a high efficiency of the hammer.

The breaker hammer shown in the drawing also comprises a pressure peak absorbing accumulator 50 which is partly formed by the hammer housing 10 and partly by a cover 51 attached to the housing 10. The accumulator 50 comprises an expansion chamber 52 which in a conventional way is divided by a flexible membrane 53 into a pressure fluid compartment 54 and a pre-pressurised gas cushion compartment 55. The expansion chamber 52 is defined by an inner wall 57 and an outer wall 58, wherein the outer wall 58 is formed by the cover 51.

There is also provided a movable membrane support member 59 consisting of a stem portion 61 and a membrane engaging head 62. The latter is located inside the pressure fluid compartment 54, whereas the stem portion 61 is displacebly guided in a bore in the inner wall 57. Openings 64 are provided in parallel with the stem portion 61 to communicate pressure fluid into the expansion chamber 52, and the head 62 of the membrane support member 59 is arranged to cover these openings 64 at low pressure levels when the membrane 53 is pressed against the inner wall 57. A spring 65 is provided to exert a bias force on the membrane support member 59 in the direction of the membrane 53. In order to limit the length of the guiding stem portion 61 there is provided a stop means in the form of a bulge shaped projection 66 on the outer expansion chamber wall 58. This projection 66 is formed integrally as a one piece member with the cover 51. This movement limiting arrangement for the membrane support 59 is simple in design as it contains no extra elements.

It is to be noted that the embodiments of the invention are not limited to the described example but can be freely varied within the scope of the claims.

The invention claimed is:

1. A hydraulic pressure peak absorbing accumulator for a hydraulic impact mechanism, comprising:

an inner chamber wall and an outer chamber wall defining an expansion chamber, a flexible membrane dividing the expansion chamber into a pressure fluid compartment and a gas cushion compartment adapted to be pre-pressurized, at least one pressure fluid communication passage extending through said inner chamber wall into said pressure fluid compartment, and a movable membrane support member comprising a membrane engaging head located in said pressure fluid compartment which contacts and supports said membrane, and a stem portion movably guided in a bore in said inner chamber wall, wherein said membrane engaging head covers said at least one fluid communication passage at low fluid pressure levels, and at high fluid pressure levels fluid enters said pressure fluid compartment and pushes said membrane in a direction from said inner chamber wall toward said outer chamber wall with said membrane engaging head in contact with said membrane, wherein an abutment portion is provided on said outer chamber wall and arranged such that at high fluid pressure levels when said fluid enters the pressure fluid compartment and pushes said membrane in the direction from said inner chamber wall toward said outer chamber wall with said membrane engaging head in contact with said membrane, said abutment portion limits the outward movement of said membrane support member, and wherein said abutment portion comprises a bulge shaped projection formed on said outer chamber wall and located opposite and co-axially with said membrane support member in order to limit a length of the stem portion.

2. The hydraulic pressure peak absorbing accumulator according to claim 1, wherein said inner chamber wall is formed by a housing structure of the hydraulic impact mechanism, and the outer chamber wall is formed by a cover secured to said housing structure, and said bulge shaped projection is formed integrally with said cover.

3. A hydraulic breaking hammer, comprising:

a housing;

a movable hammer piston housed by said housing;

flow means for conducting a flow of pressure fluid through said housing to drive said hammer piston; and the hydraulic pressure peak absorbing accumulator according to claim 2, wherein said at least one pressure fluid communication passage communicates with said flow means.

4. A hydraulic breaking hammer, comprising the hydraulic pressure peak absorbing accumulator according to claim 2.

5. The hydraulic pressure peak absorbing accumulator according to claim 1, wherein said membrane engaging head is arranged such that at low fluid pressure levels said membrane engaging head, while in contact with said membrane, covers said at least one fluid communication passage, and at high fluid pressure levels said member engaging head, while in contact with said membrane, moves outward toward said bulge shaped projection until said membrane contacts said bulge shaped projection.

6. The hydraulic pressure peak absorbing accumulator according to claim 1, wherein said membrane is movable based on a pressure difference between said pressure fluid compartment and said gas cushion compartment.

7. The hydraulic pressure peak absorbing accumulator according to claim 1, wherein said at least one pressure fluid communication passage is arranged in parallel with said bore in which said stem portion is movably guided.

8. The hydraulic pressure peak absorbing accumulator according to claim 1, wherein said at least one pressure fluid communication passage comprises a plurality of pressure fluid communication passages which are arranged in parallel with said bore in which said stem portion is movably guided.

9. The hydraulic pressure peak absorbing accumulator according to claim 1, wherein said at least one pressure fluid communication passage is arranged alongside said bore in which said stem portion is movably guided.

10. The hydraulic pressure peak absorbing accumulator according to claim 1, wherein said membrane is arranged such that at low fluid pressure levels, said membrane is pressed against said inner chamber wall causing said membrane engaging head to cover said at least one fluid communication passage.

11. The hydraulic pressure peak absorbing accumulator according to claim 1, further comprising a biasing mechanism arranged to exert a biasing force to urge said membrane support member into contact with said membrane and in a direction outward from said inner chamber wall.

12. The hydraulic pressure peak absorbing accumulator according to claim 11, wherein said biasing mechanism is a spring.

13. The hydraulic pressure peak absorbing accumulator according to claim 1, wherein said bulge shaped projection is integral with said outer wall.

14. A hydraulic impact mechanism, comprising:

a housing;

a movable piston arranged at least partly in said housing;

flow means for conducting a flow of pressure fluid through said housing to drive said piston; and the hydraulic pressure peak absorbing accumulator according to claim 1, wherein said at least one pressure fluid communication passage communicates with said flow means.

15. A hydraulic breaking hammer, comprising:

a housing;

a movable hammer piston housed by said housing;

flow means for conducting a flow of pressure fluid through said housing to drive said hammer piston; and the hydraulic pressure peak absorbing accumulator according to claim 1, wherein said at least one pressure fluid communication passage communicates with said flow means.

16. A hydraulic breaking hammer, comprising the hydraulic pressure peak absorbing accumulator according to claim 1.

* * * * *